US006460747B1

(12) United States Patent
Tuerschmann et al.

(10) Patent No.: US 6,460,747 B1
(45) Date of Patent: Oct. 8, 2002

(54) DUAL STRAP APPARATUS FOR GOLF BAGS

(75) Inventors: Gary L. Tuerschmann, Phoenix, AZ (US); Nip T. Lim, Glendale, AZ (US); Gary E. Keller, Mesa, AZ (US)

(73) Assignee: Karsten Manufacturing Corp., Phoenix, AZ (US)

( * ) Notice: Subject to any disclaimer, the term of this patent is extended or adjusted under 35 U.S.C. 154(b) by 0 days.

(21) Appl. No.: 09/849,652

(22) Filed: May 4, 2001

(51) Int. Cl.[7] ..... A45F 3/04

(52) U.S. Cl. ..... 224/645; 224/264; 224/627; 206/315.3; D3/327

(58) Field of Search ..... 224/627, 629, 224/631, 643, 645, 258, 259, 260, 261, 264; 206/315.3; D3/327

(56) References Cited

U.S. PATENT DOCUMENTS

| | | | | | |
|---|---|---|---|---|---|
| 191,027 | A | * | 5/1877 | Case et al. | 2/94 |
| 2,853,111 | A | | 9/1958 | Williams | |
| 5,038,984 | A | * | 8/1991 | Izzo | 206/315.3 |
| 5,042,704 | A | | 8/1991 | Izzo | |
| 5,184,764 | A | * | 2/1993 | Orovan et al. | 224/262 |
| 5,269,449 | A | | 12/1993 | Sattler | |
| 5,348,205 | A | | 9/1994 | Steurer | |
| 5,356,003 | A | | 10/1994 | Gretz | |
| 5,558,259 | A | | 9/1996 | Izzo | |
| 5,636,778 | A | | 6/1997 | Jones | |
| D387,556 | S | | 12/1997 | Beebe | |
| D409,838 | S | * | 5/1999 | Steurer | 224/645 |
| D411,666 | S | | 6/1999 | Reimers | |
| D412,396 | S | | 8/1999 | Reimers | |
| 5,954,254 | A | * | 9/1999 | Maeng | 206/315.3 |
| 5,954,255 | A | | 9/1999 | Beebe | |
| 6,152,343 | A | * | 11/2000 | Shin | 224/259 |
| 6,168,060 | B1 | * | 1/2001 | Mayers | 224/257 |
| D438,705 | S | * | 3/2001 | Steurer | D3/327 |
| 6,305,535 | B1 | * | 10/2001 | Fair | 206/315.3 |

* cited by examiner

*Primary Examiner*—Stephen K. Cronin
(74) *Attorney, Agent, or Firm*—Darrell F. Marquette

(57) ABSTRACT

A dual strap apparatus is disclosed for use with a golf bag of the type having a generally tubular body with an open top end and a closed bottom end. The dual strap apparatus includes a V-shaped shoulder strap having first and second portions that extend in opposed directions from a vertex. A first coupling strap is connected between the strap first portion and the body top end, and a second coupling strap is connected between the strap second portion and a location on the body intermediate the top and bottom ends of the body. In one embodiment of the dual strap apparatus, first and second hold-down straps are coupled to a common point on the vertex of the shoulder strap. The first hold-down strap is connected to the body top end, and the second hold-down strap is connected to the body at another location intermediate the body top and bottom ends. In another embodiment of the dual strap apparatus, a single hold-down strap is coupled to a point on the vertex of the shoulder strap. The single hold-down strap is connected to the body top end and to the body at another location intermediate the body top and bottom ends.

12 Claims, 7 Drawing Sheets

DUAL STRAP APPARATUS FOR GOLF BAGS

BACKGROUND OF THE INVENTION

This invention relates generally to golf equipment and, in particular, to a dual strap apparatus for golf bags.

Golfers normally transport their golf bags which contain golf clubs and other equipment needed to play golf by utilizing a motorized cart, a pull cart or by carrying the golf bags. A golf bag containing golf clubs and other equipment is of considerable weight which may result in shoulder fatigue and soreness to a golfer if the golf bag is provided with a conventional single shoulder strap which is looped over only one shoulder at a time. As a result, some golfers who would prefer to carry their golf bags have resorted to using motorized carts or pull carts. Therefore, golf bag strap systems which minimize or eliminate such undue shoulder fatigue and soreness are desirable.

Golf bag manufacturers have recently been marketing what are commonly referred to as "dual" or "double" strap systems. Dual or double strap systems usually employ two loop-shaped shoulder straps or a single shoulder strap shaped to form two loops so that the golf bag is, properly balanced and evenly supported on both shoulders rather than on only one shoulder. These dual or double strap systems have been effective in alleviating shoulder fatigue and soreness when golfers carry their golf bags.

U.S. Pat. No. 2,853,111 to A. K. Williams discloses a golf bag with a pair of shoulder straps arranged side by side. Each strap has one end permanently fastened to the golf bag and another end detachably fastened to the golf bag by a buckle.

U.S. Pat. No. 5,042,704 to T. J. Izzo discloses a strap carrying system for golf bags including a single shoulder strap that is connected to a golf bag at three longitudinally spaced locations to provide a pair of loops which may be supported on a golfer's shoulders.

U.S. Pat. No. 5,269,449 to W. A. Sattler discloses a supplemental carry strap for use on conventional golf bags having a handle and a single shoulder strap. The supplemental strap of Sattler includes a shoulder element connected to a coupling element which is connected to the golf bag handle by a hook and loop fastener.

U.S. Pat. No. 5,348,205 to S. T. Steurer discloses a strap arrangement for golf bags consisting of two shoulder straps adapted for connection to a handle on a golf bag. In another embodiment, Steurer discloses a strap arrangement including a secondary shoulder strap connected to a golf bag handle.

U.S. Pat. No. 5,558,259 to T. J. Izzo discloses a dual strap assembly including a first strap having its upper end attached at two laterally spaced locations adjacent a top end of the golf bag and having its lower end attached at two laterally spaced locations between the top and bottom ends of the golf bag. A second strap has one end attached to a handle on the golf bag and its other end is attached to the golf bag near the locations where the lower end of the first strap is attached.

U.S. Pat. No. 5,954,255 to J. N. Beebe et al discloses a dual strap arrangement including a first strap having an upper end attached to a golf bag at a first location that is near a top end of the golf bag and having a lower end attached to the golf bag at a second location that is between the top end and a bottom end of the golf bag. A second strap has its upper end attached to the golf bag at a third location that is laterally spaced from the first location and has its lower end attached to the golf bag at a fourth location that is laterally spaced from the second location. The two straps cross each other and form an X-shaped pattern.

SUMMARY OF THE INVENTION

The present invention provides a dual strap apparatus for use with a golf bag of the type having a generally tubular body with a top end which is open and a bottom end which is closed. The dual strap apparatus includes a V-shaped shoulder strap with first and second portions that extend in opposite directions from a vertex. A first coupling strap is connected between the first portion of the V-shaped shoulder strap and the top end of the body, and a second coupling strap is connected between the second portion of the V-shaped shoulder strap and a location on the body intermediate the top and bottom ends thereof. In one embodiment of the dual strap apparatus, first and second hold-down straps are coupled to a common point on the vertex of the V-shaped shoulder strap. The first hold-down strap is connected to the top end of the body and the second hold-down strap is connected to the body at another location intermediate the top and bottom ends thereof for holding the V-shaped shoulder strap in a desired position on a person's back when the dual strap apparatus is used to carry the golf bag. A throat structure may define the top end of the body, and the first coupling strap and the first hold-down strap may be connected to the throat structure. The dual strap apparatus may also include a ring attached to the V-shaped shoulder strap at the vertex, and the first and second hold-down straps will be connected to the ring and extend in opposite directions therefrom. In this embodiment of the dual strap apparatus, the ring comprises a generally triangular shape with three sides formed by three bars positioned in three different orientations so that the first and second hold-down straps are each connected to a different one of the bars while the other bar is connected to the V-shaped shoulder strap at the vertex by a mounting strap. Adjustment devices may also be provided in the dual strap apparatus for adjusting the overall lengths of the coupling straps and the hold-down straps.

In another embodiment of the dual strap apparatus, first and second coupling straps are connected as mentioned above and a single hold-down strap is coupled to a point on the vertex of the V-shaped shoulder strap. The single hold-down strap is connected to the top end of the body and to the body at another location intermediate the top and bottom ends thereof. A ring is attached to the V-shaped shoulder strap at the vertex, and the single hold-down strap passes through the ring and extends in opposed directions therefrom. In this embodiment, the ring comprises a generally rectangular shape with two sides thereof formed by two bars which are spaced apart so that the single hold-down strap slidably passes-over one of the bars while the other bar is connected to the V-shaped shoulder strap at the vertex by a mounting strap.

DESCRIPTION OF THE PREFERRED EMBODIMENTS

Figure 1:
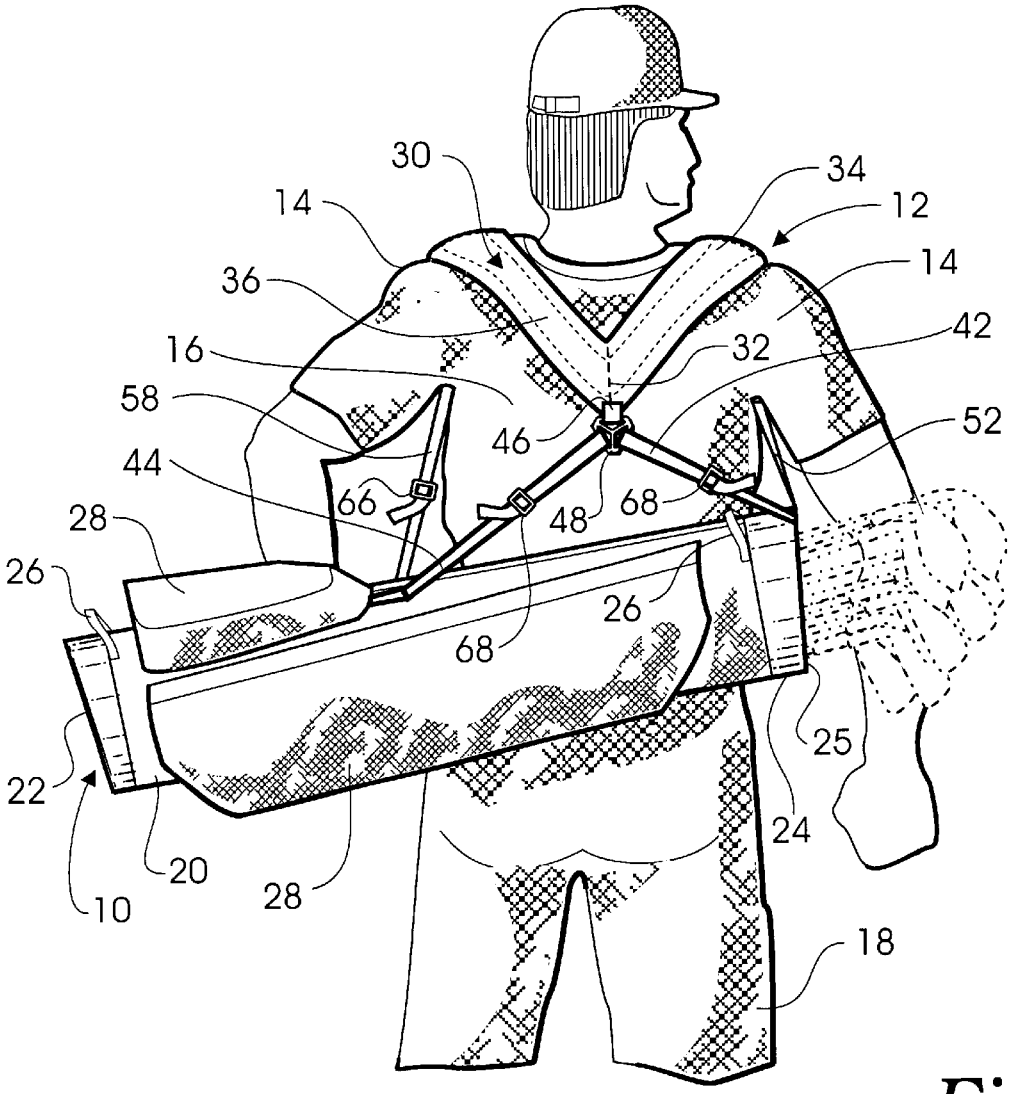
FIG. 1 is a perspective view of a dual strap apparatus according to one embodiment of the present invention while being used to carry a golf bag.

Referring to the drawings, FIG. 1 shows a golf bag 10 having a dual strap apparatus 12 according to one embodiment of the present invention which is used for carrying the golf bag 10 on the shoulders 14 and the back 16 of a person 18. The golf bag 10 is provided with a generally tubular body 20 having a closed bottom end 22 and a throat structure 24 such as disclosed in U.S. Pat. No. 4,596,328 to J. A. Solheim. The throat structure 24 defines an open top end 25 of the body 20. The golf bag 10 may also be provided with handles 26 for lifting and pockets 28 for carrying equipment used in playing golf.

Figure 2:
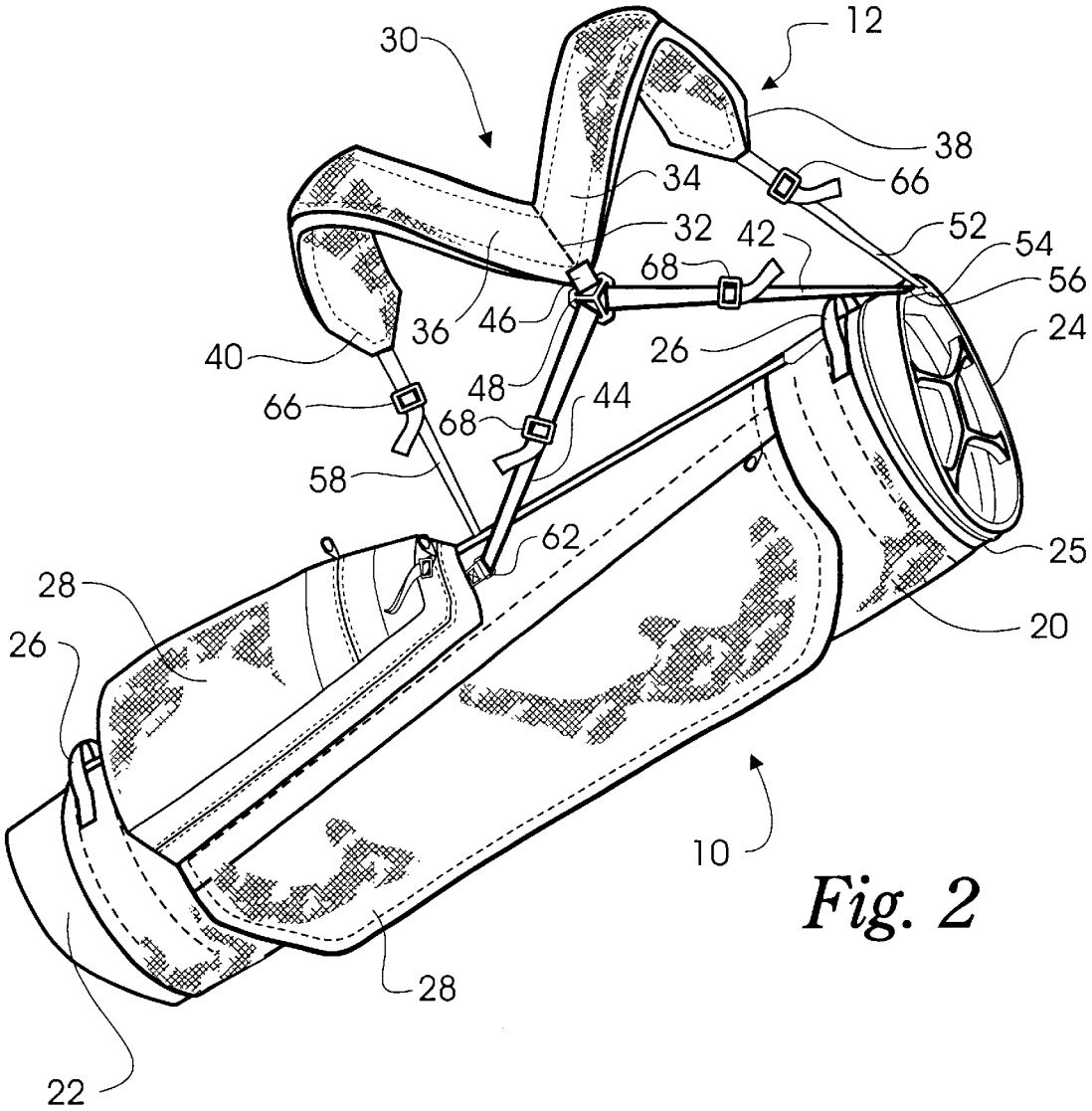
FIG. 2 is an enlarged perspective view of the golf bag and the dual strap apparatus shown in FIG. 1.

As seen best in FIG. 2, the dual strap apparatus 12 includes a V-shaped shoulder strap 30 having a vertex 32 located where first and second portions 34 and 36, respectively, of the shoulder strap 30 intersect. The strap portions 34 and 36 extend in opposed directions from the vertex 32 and terminate at their respective outer ends 38 and 40. The strap portions 34, 36 are preformed to fit comfortably over the shoulders 14 of the person 18 carrying the golf bag 10. The dual strap apparatus 12 also includes a pair of hold-down straps 42 and 44 which are coupled to a common point on the vertex 32 of the V-shaped strap 30 by a strap 46 and a ring 48.

Figure 3:
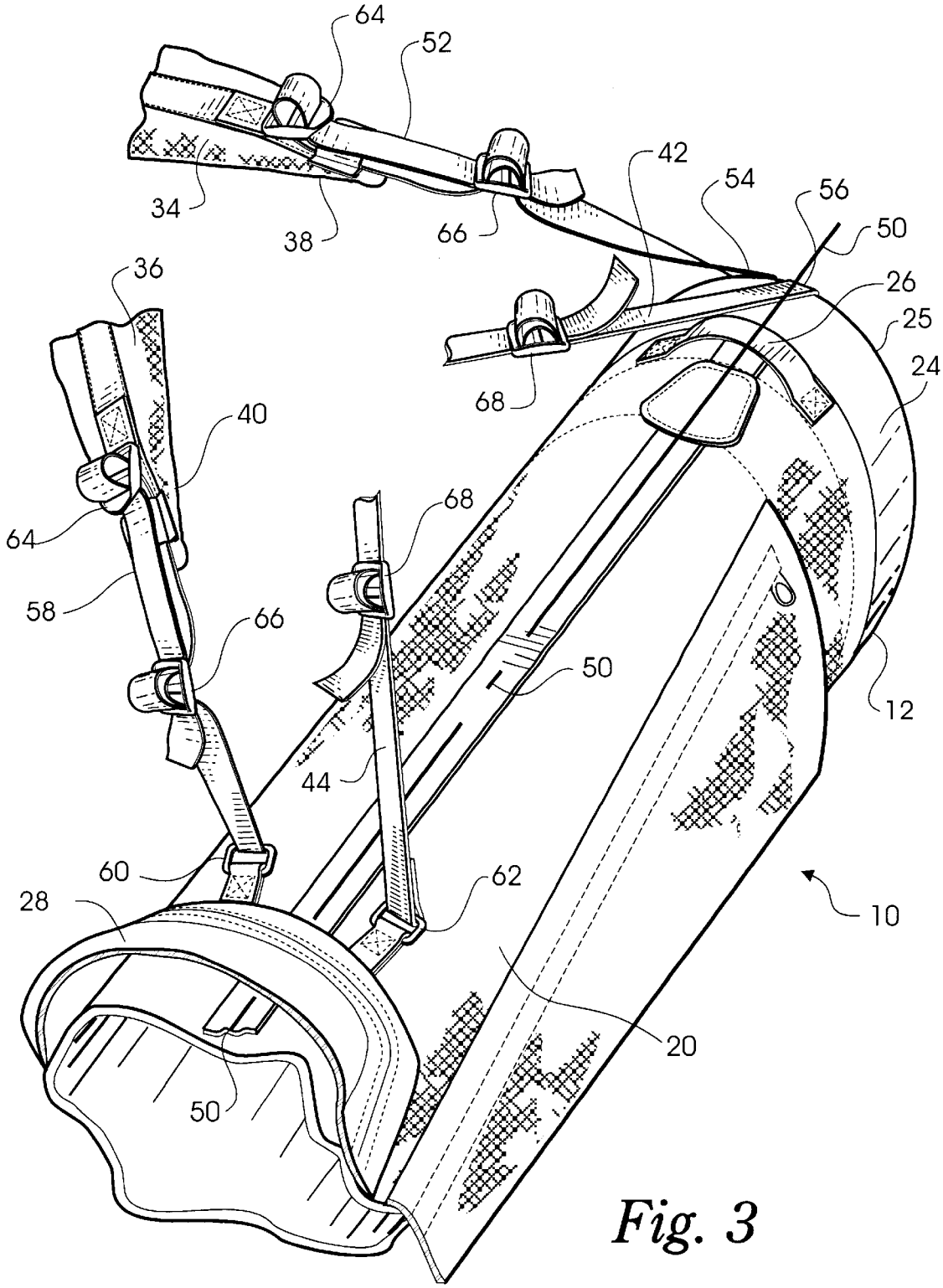
FIG. 3 is a further enlarged perspective view, partially broken away, showing portions of the golf bag and the dual strap apparatus shown FIGS. 1 and 2.
Figure 6:
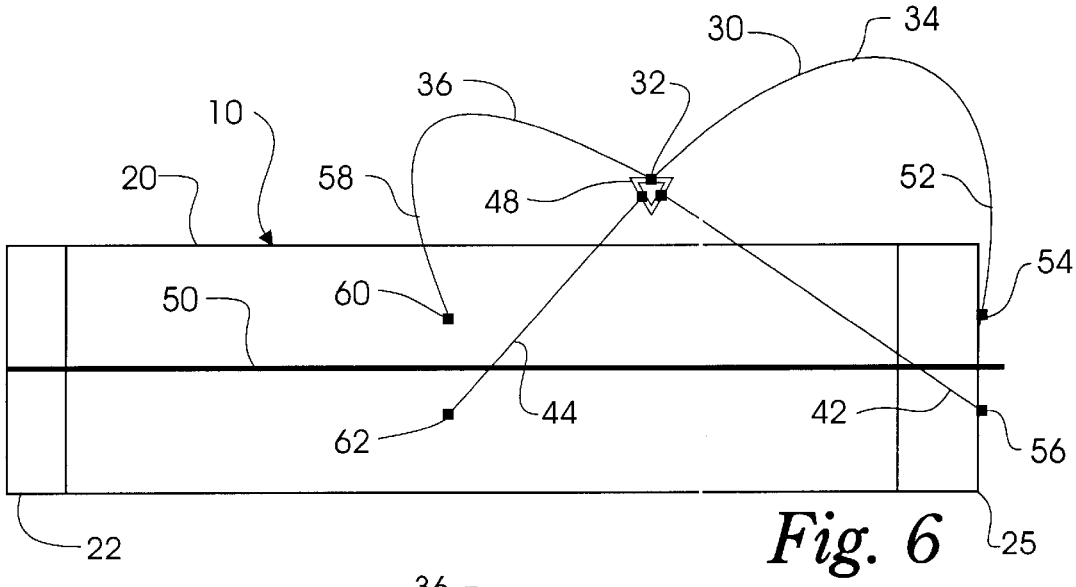
FIGS. 6–8 are schematic views of the dual strap apparatus shown in FIGS. 1 and 2.
Figure 7:
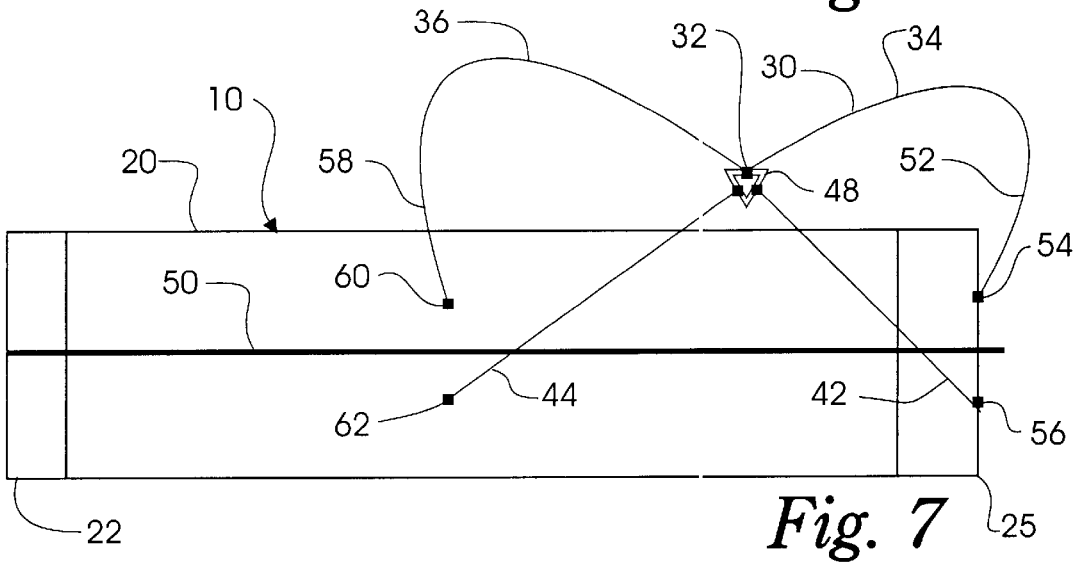
Figure 8:
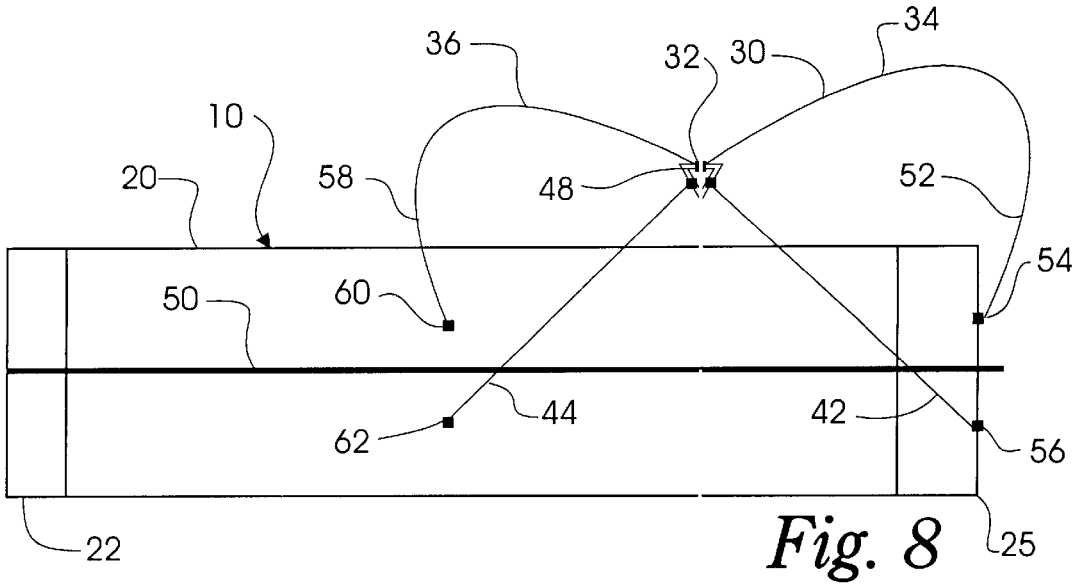

Referring now to FIG. 3, connections of the shoulder strap 30 and the hold-down straps 42 and 44 to the body 20 are best seen. The body 20 has a spinal axis 50 which extends longitudinally thereof. The outer end 38 of the strap portion 34 is connected by a coupling strap 52 to the top end 25 of the body 20 at an opening 54 formed in the throat structure 24. As also shown in FIGS. 6–8, the opening 54 is spaced circumferentially from the spinal axis 50. The hold-down strap 42 extends from the ring 48 and is attached to another opening 56 formed in the throat structure 24 that is spaced circumferentially from the spinal axis 50 opposite the opening 54. The outer end 40 of the strap portion 36 is connected by a coupling strap 58 to a location 60 which is intermediate the top and bottom ends 22, 25 of the body 20 and which is spaced circumferentially from the spinal axis 50. The hold-down strap 44 extends from the ring 48 and is attached to another location 62 which is intermediate the body top and bottom ends 22, 25 and which is spaced circumferentially from the spinal axis 50 opposite the location 60. It will be understood that the outer ends 38, 40 of the strap portions 34, 36 are connected by the coupling straps 52, 58 to the opening 54 and the location 60 which are on one side of the spinal axis 50. Similarly, the outer ends of the hold-down straps 42 and 44 are attached to the opening 56 and the location 62 which are on the other side of the spinal axis 50.

The coupling straps 52 and 58 are provided with adjustment devices, such as buckles 64 and 66, so that the overall lengths of the coupling straps 52, 58 may be adjusted. The hold-down straps 42 and 44 are also provided with adjustment devices such as buckles 68 so that the overall lengths of the hold-down straps 42, 44 may be adjusted. Adjusting the overall lengths of the coupling straps 52, 58 and the hold-down straps 42, 44 allows the golf bag 10 to be raised or lowered and oriented at various angles across the person's back 16 to suit particular physical characteristics and personal preferences of the person 18.

Figure 4:
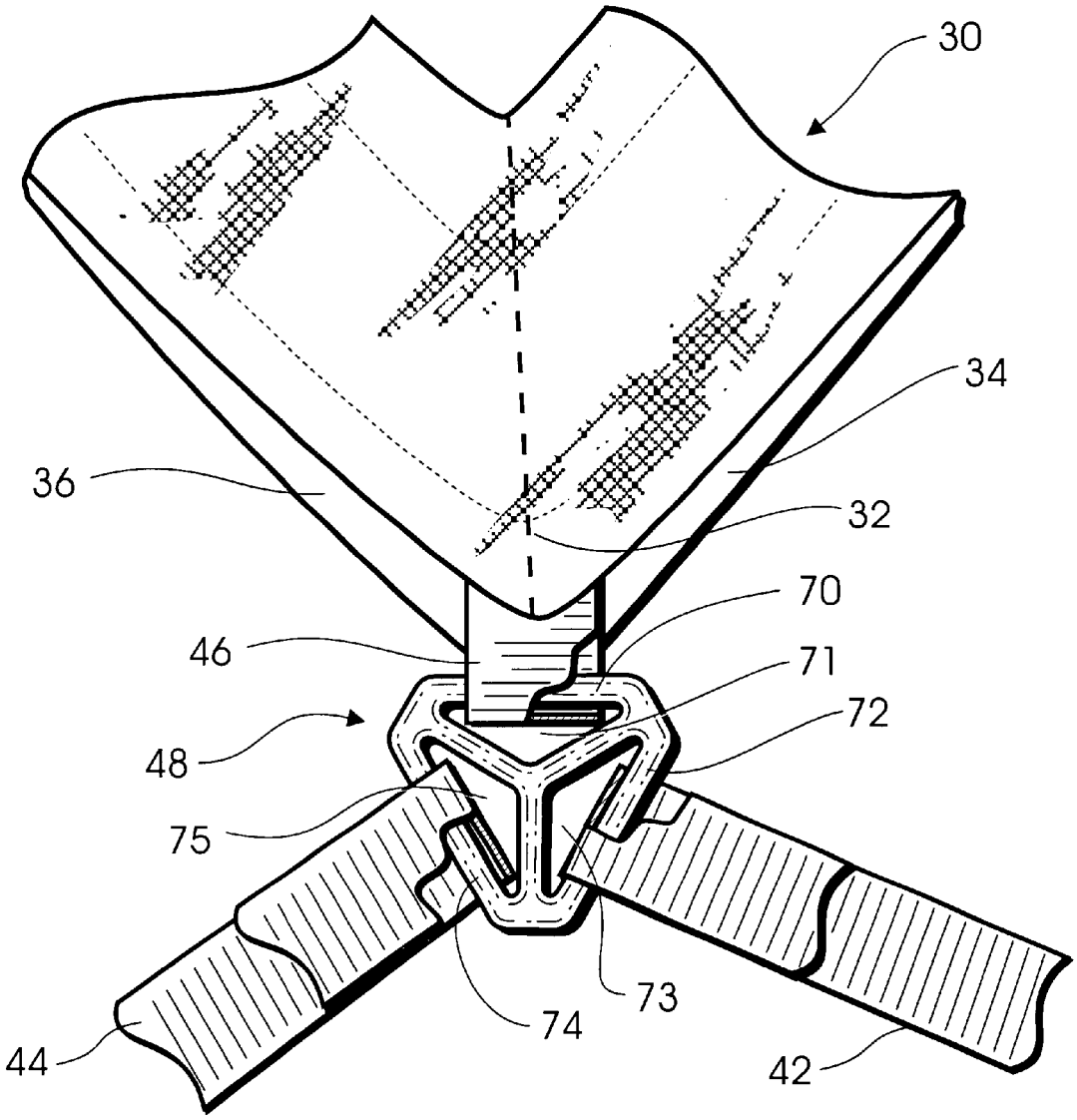
FIG. 4 is an enlarged view of a portion of the dual strap apparatus shown in FIGS. 1 and 2.

Reference is now made to FIG. 4 wherein the ring 48 is shown. The ring 48 has a generally triangular shape with three sides formed by bars 70, 72 and 74 facing in three different directions and arranged at angles of approximately 60 degrees relative to each other. Three openings 71, 73, 75 are formed in the ring 48 so that one of the openings 71, 73, 75 is adjacent each of the bars 70, 72, 74. The strap 46 is looped around the bar 70 and through the opening 71 thus coupling the ring 48 to the vertex 32 of the shoulder strap 30. The hold-down strap 42 is looped around the bar 72 and through the opening 73 while the hold-down strap 44 is looped around the remaining bar 74 and through the opening 75.

If the center of gravity of the golf bag 10 changes, FIGS. 6–8 illustrate that the ring 48 may be moved to different positions relative to spinal axis 50 of the body 20 in order to properly balance and evenly support the golf bag 10 on a person's shoulders. Movement of the ring 48 to these different positions is effected by utilizing the buckles 66, 68 to adjust the overall lengths of the coupling straps 52, 58 and the hold-down straps 42, 44.

Figure 5:
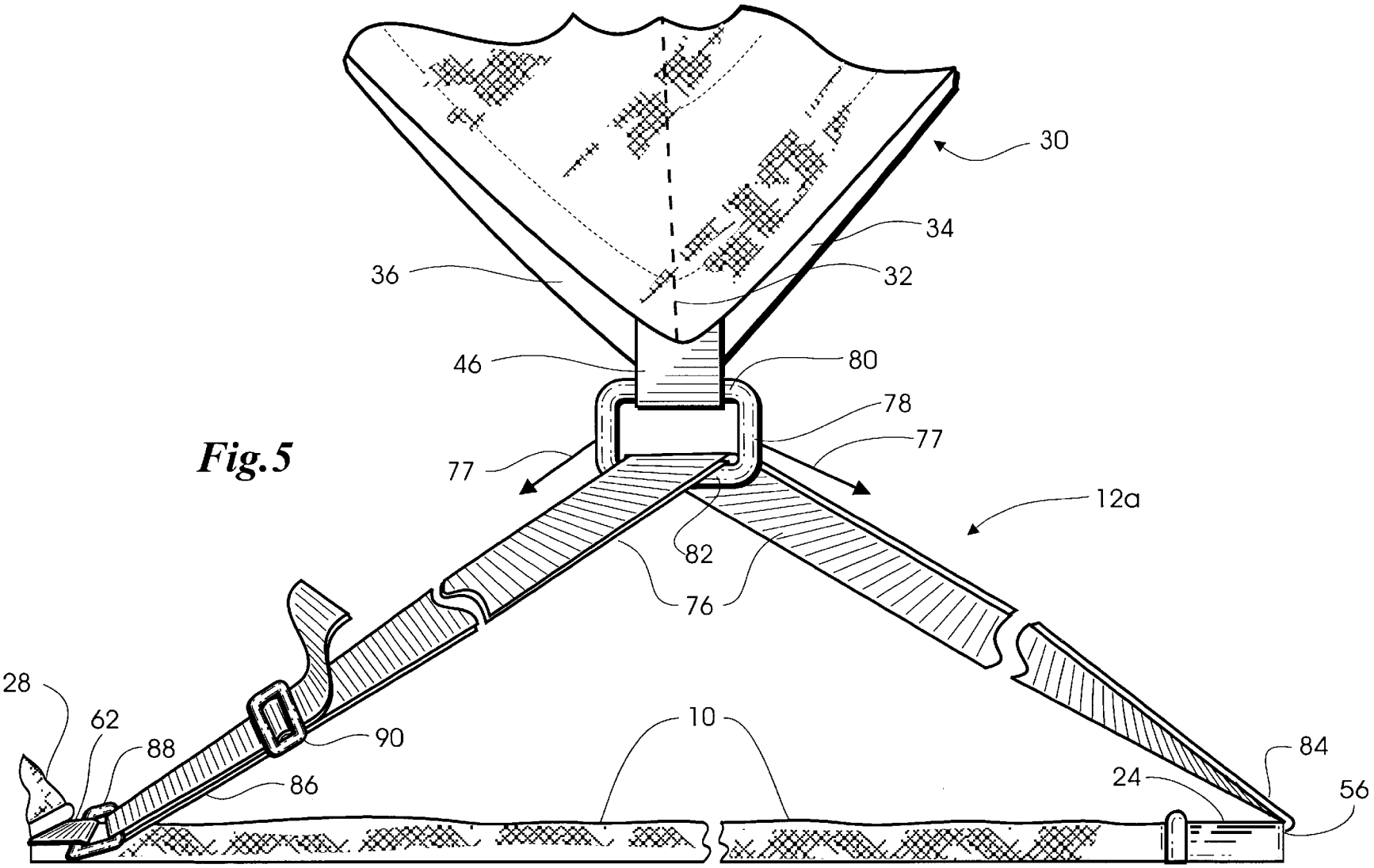
FIG. 5 is a view similar to FIG. 4 showing a portion of another embodiment of the dual strap apparatus.
Figure 9:
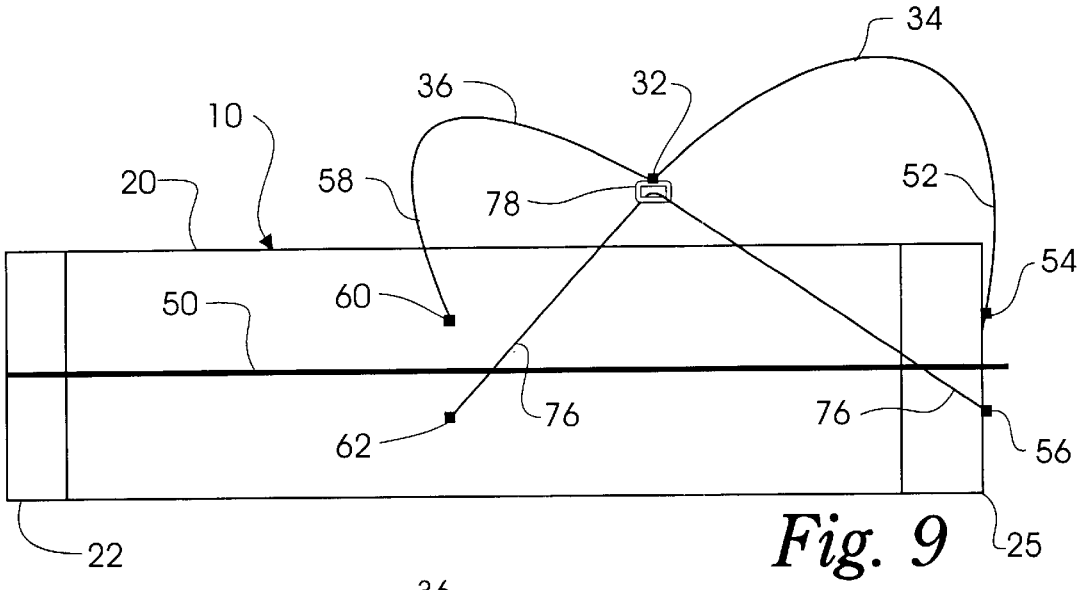
FIGS. 9–11 are schematic views of the dual strap apparatus shown in FIG. 5.
Figure 10:
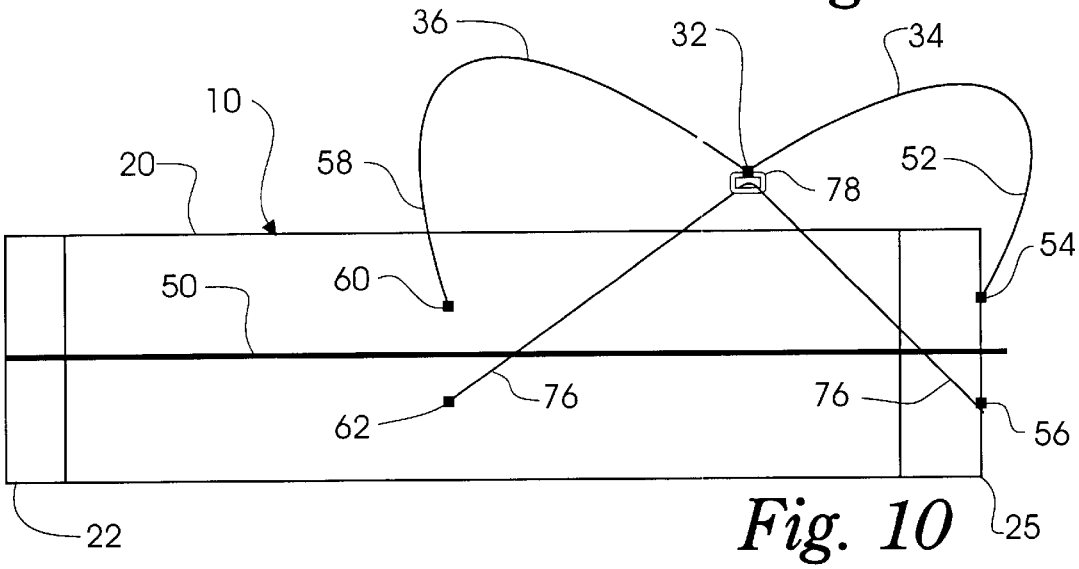
Figure 11:
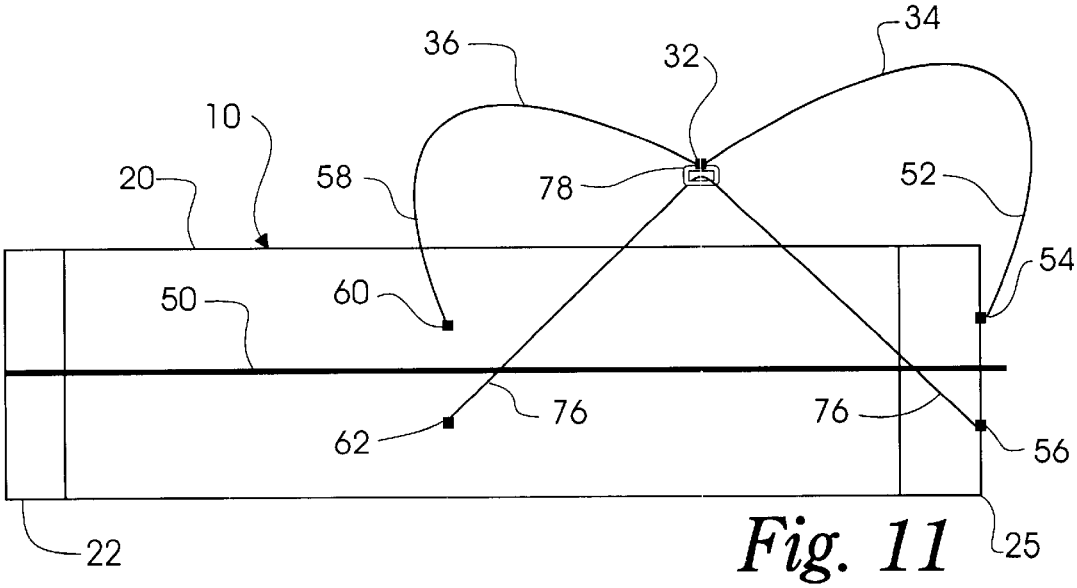

FIG. 5 shows a dual strap apparatus 12*a* according to another embodiment of the present invention wherein a single hold-down strap 76 is employed instead of the two hold-down straps 42 and 44 of the dual strap apparatus 12. A ring 78 has a generally rectangular shape with two sides thereof formed by bars 80 and 82. The strap 46 extends around the bar 80 to couple the ring 78 to the shoulder strap 30 at the vertex 32, and the single hold-down strap 76 slidably passes over the other bar 82. The upper end 84 of the single hold-down strap 76 is attached to the throat structure 24 at the opening 56 and the lower end 86 thereof is looped through a buckle 88 at the location 62 as also shown in FIGS. 9–11. An adjustment device, such as buckle 90, is provided for adjusting the overall length of the single hold-down strap 76.

It will be understood that the ring 78 is slidable relative to the single hold-down strap 76 as indicated by arrows 77 in FIG. 5. If the center of gravity of the golf bag 10 changes, FIGS. 9–11 illustrate that the ring 76 will slide along the single hold-down strap 76 and move to different positions relative to the spinal axis 50 of the body 20 in order to properly balance and evenly support the golf bag 10 on a person's shoulders. Movement of the ring 76 to these different positions may result in a need to adjust the overall lengths of the coupling straps 52, 58 by utilizing the buckles 66.

What is claimed is:

1. A dual strap apparatus for use with a golf bag having a generally tubular body with a top end which is open and a bottom end which is closed, said dual strap apparatus comprising:

a V-shaped should stop including a vertex and having first and second portions extending in opposed directions from said vertex;

a first coupling straps connected between the first portion of said V-shaped shoulder strap and the top end of said body;

a second coupling strap connected between the second portion of said V-shaped shoulder strap and a location on said body intermediate the top and bottom ends thereof;

first and second hold-down straps coupled to a common point on the vertex of said V-shaped shoulder strap, said first hold-down strap connected to the top end of said body and said second hold-down stop connected to said body at another location intermediate the top and bottom ends thereof for holding said V-shaped shoulder strap in a desired position on a person's back when tile dual strap apparatus is used to carry the golf bag; and a ring attached to said V-shaped shoulder strap at said vertex, and wherein said first and said second hold-down straps are connected to said ring and extend in opposed directions therefrom.

2. The dual strap apparatus of claim 1, wherein said location and said another location are spaced apart circumferentially on said body.

3. The dual strap apparatus of claim 1, further comprising a throat structure defining said top end of said body, and wherein said first coupling strap and said first hold-down strap are connected to said throat structure.

4. The dual strap apparatus of claim 1, wherein said ring comprises a generally triangular shape with three sides formed by three bars positioned in three different orientations, and wherein said first and second hold-down straps are each connected to a different one of said three bars while the third one of said three bars is connected to said V-shaped shoulder strap at said vertex by a mounting strap.

5. The dual strap apparatus of claim 1, wherein said first and second coupling straps each have an overall length, and further comprising adjustment devices on said first and second coupling straps for adjusting the overall lengths of said first and second coupling straps.

6. The dual strap apparatus of claim 1, wherein said first and second hold-down straps each have an overall length, and further comprising adjustment devices on said first and second hold-down straps for adjusting the overall lengths of said first and second hold-down straps.

7. A dual strap apparatus for use with a golf bag having a generally tubular body with a top end which is open and a bottom end which is closed, said dual strap apparatus comprising:

a V-shaped shoulder strap including a vertex and having first and second portions extending in opposed directions from said vertex;

a first coupling strap connected between the first portion of said V-shaped shoulder strap and the top end of said body;

a second coupling strap connected between the second portion of said V-shaped shoulder strap and a location on said body intermediate the top and bottom ends thereof;

a single hold-own strap coupled to a point on the vertex of said V-shaped shoulder strap, said single hold-down strap connected to the top end of said body and to said body at another location intermediate the top and bottom ends thereof for holding said V-shaped shoulder strap in a desired position on a person's back when the dual strap apparatus is used to carry the golf bag; and a ring attached to said V-shaped shoulder strap at said vertex, and wherein said single hold-down strap passes through said ring and extends in opposed directions therefrom.

8. The dual strap apparatus of claim 7, wherein said location and said another location are spaced apart circumferentially on said body.

9. The dual strap apparatus of claim 7, further comprising a throat structure defining said top end of said body, and wherein said first coupling strap and said single hold-down strap are connected to said throat structure.

10. The dual strap apparatus of claim 7, wherein said ring comprises a generally rectangular shape with two sides thereof formed by two bars which are spaced apart, and wherein said single hold-down strap slidably passes over one of said two bars while the other one of said two bars is connected to said V-shaped shoulder shaped at said vertex by a mounting strap.

11. The dual strap apparatus of claim 7, wherein said first and second coupling straps each have an overall length, and further comprising adjustment devices on said first and second coupling straps for adjusting the overall lengths of said first and second coupling straps.

12. The dual strap apparatus of claim 7, wherein said single hold-down strap has an overall length, and further comprising an adjustment device on said single hold-down strap for adjusting the overall length of said single hold-down strap.

* * * * *